US010431041B2

(12) United States Patent
Olive

(10) Patent No.: US 10,431,041 B2
(45) Date of Patent: Oct. 1, 2019

(54) MULTI-LINE GAMING MACHINE WITH SINGLE WAGER OPTION

(75) Inventor: Scott C. Olive, Balgowlah (AU)

(73) Assignee: ARISTOCRAT TECHNOLOGIES AUSTRALIA PTY LTD., North Ryde, NSW (AU)

( * ) Notice: Subject to any disclaimer, the term of this patent is extended or adjusted under 35 U.S.C. 154(b) by 0 days.

(21) Appl. No.: 13/402,644

(22) Filed: Feb. 22, 2012

(65) Prior Publication Data

US 2012/0157182 A1 Jun. 21, 2012

Related U.S. Application Data

(63) Continuation of application No. 10/826,641, filed on Apr. 15, 2004, now Pat. No. 8,172,663.

(30) Foreign Application Priority Data

Apr. 15, 2003 (AU) ..... 2003901786

(51) Int. Cl.
*G07F 17/32* (2006.01)

(52) U.S. Cl.
CPC ..... *G07F 17/3244* (2013.01)

(58) Field of Classification Search
CPC .. G07F 17/32; G07F 17/3211; G07F 17/3213; G07F 17/3244; G07F 17/3246; G07F 17/3248; G07F 17/3258; G07F 17/326; G07F 17/3262; G07F 17/3265; G07F 17/3267
USPC ..... 463/20, 16
See application file for complete search history.

(56) References Cited

U.S. PATENT DOCUMENTS

| | | | | |
|---|---|---|---|---|
| 4,715,604 | A | 12/1987 | Okada | |
| 5,050,881 | A | 9/1991 | Nagao | |
| 6,033,307 | A | 3/2000 | Vancura | |
| 6,059,289 | A | 5/2000 | Vancura | |
| 6,203,430 | B1 * | 3/2001 | Walker | G06F 19/3456 273/143 R |
| 6,394,902 | B1 | 5/2002 | Glavich et al. | |
| 6,413,161 | B1 | 7/2002 | Baerlocher et al. | |
| 6,413,162 | B1 | 7/2002 | Baerlocher et al. | |
| 6,939,223 | B1 | 9/2005 | Jones | |
| 8,747,205 | B2 * | 6/2014 | Englman | 463/16 |

(Continued)

FOREIGN PATENT DOCUMENTS

| | | |
|---|---|---|
| AU | 771847 | 3/2001 |
| AU | 749222 | 6/2002 |

(Continued)

*Primary Examiner* — Tramar Y Harper
*Assistant Examiner* — Jeffrey K Wong
(74) *Attorney, Agent, or Firm* — McAndrews, Held & Malloy, Ltd.

(57) ABSTRACT

A gaming machine for playing a multi-line spinning reel game includes a display and a game controller arranged to control images of symbols displayed on the display. In the game at least one random event, in particular a spin of the reels, is caused to be displayed on the display. If a predefined winning event occurs, the machine awards a prize. The player is constrained to wager a single amount on each play of the game and may not vary the amount. This single wager amount provides eligibility to play all available lines of the game and eligibility to bonus features. No choice of other wagering options is provided.

20 Claims, 7 Drawing Sheets

(56) References Cited

U.S. PATENT DOCUMENTS

| | | | | |
|---|---|---|---|---|
| 2001/0016513 | A1 | 8/2001 | Muir et al. | |
| 2002/0077171 | A1 | 6/2002 | Ainsworth | |
| 2002/0193158 | A1* | 12/2002 | Weiss et al. | 463/16 |
| 2003/0064779 | A1 | 4/2003 | Suda | |
| 2003/0073477 | A1* | 4/2003 | Baerlocher | G07F 17/32 463/16 |
| 2003/0073483 | A1* | 4/2003 | Glavich | G07F 17/32 463/20 |
| 2003/0114215 | A1 | 6/2003 | Adams et al. | |
| 2003/0220135 | A1* | 11/2003 | Gauselmann | G07F 17/3202 463/25 |
| 2003/0222402 | A1* | 12/2003 | Olive | G07F 17/3258 273/292 |
| 2004/0072607 | A1* | 4/2004 | Thomas et al. | 463/16 |
| 2004/0106446 | A1 | 6/2004 | Cannon et al. | |
| 2004/0166930 | A1* | 8/2004 | Beaulieu | G07F 17/32 463/25 |
| 2004/0219963 | A1 | 11/2004 | Vancura | |
| 2006/0135249 | A1* | 6/2006 | Seelig | G07F 17/32 463/22 |

FOREIGN PATENT DOCUMENTS

| | | | | |
|---|---|---|---|---|
| EP | 0984409 | | 3/2000 | |
| GB | 2083935 | | 3/1982 | |
| GB | 2083935 | A * | 3/1982 | G07F 17/34 |
| WO | 01/33478 | | 5/2001 | |

* cited by examiner

MULTI-LINE GAMING MACHINE WITH SINGLE WAGER OPTION

CROSS-REFERENCE TO RELATED APPLICATIONS

This application is a continuation of U.S. application Ser. No. 10/826,641, filed Apr. 15, 2004, which claims priority under 35 U.S.C. § 119 to Australian provisional application No. 2003901786, filed Apr. 15, 2003 and entitled "Jackpot Deluxe," the entirety of each of the above referenced applications are incorporated herein by reference.

FIELD OF THE INVENTION

This invention relates to a gaming machine. More particularly, the invention relates to a gaming machine and to an improvement to a game played on such a gaming machine.

BACKGROUND OF THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games and/or game features which are popular with the players as a mechanism for improving sales, retaining customers and attracting new customers.

One particular feature which has generated increased interest in gaming machines is the provision of bonus games also known as feature; games. These games are often provided as a series of "free" games which are triggered by the appearance of a particular indicia combination in the underlying game played on the gaming machine. However, for many bonus games, a player is required to make an ante-bet in order to be eligible to enter the bonus feature and this acts as a disincentive for players playing bonus games. For example Australian patent No 11194/01 entitled "Gaming machine with eligibility for participation in features" is one such game which requires a player to make an ante-bet prior to participating in a bonus game. Australian application No 65501/00 "Gaming machine with buy feature games", discloses another gaming machine game which requires feature games to be bought by the player.

The requirement for players to buy bonus games also has the disadvantage that it may make the calculation of the probabilities of winning more complicated.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF SUMMARY OF THE INVENTION

In a first broad aspect, the present invention provides a gaming machine arranged to play a game in which a player wagers a single amount which provides eligibility to all elements of the game including eligibility to bonus features without choice of any other wagering options.

Embodiments of the invention may provide a number of advantages over existing gaming machines. For example, it is not necessary to weight the jackpot of the prize for different bet sizes since all initial bets are the same. Secondly it is possible to tailor the statistics of the game to the one allowed bet rather than to a large range of bet profiles, thereby directly appealing to the target player.

More specifically, according to a second aspect of the present invention, there is provided a spinning reel type gaming machine having a display means and a game control means arranged to control images of symbols carried on reels and displayed on the display means, the gaming machine providing a plurality of pay lines, and being arranged to play a base game in which at least one random event is caused to be displayed on the display means and, if a predefined winning event occurs, the machine awards a prize, and wherein on the occurrence of a predetermined triggering event gaming machine provides at least one bonus feature, and wherein the player is constrained to wager a single amount on each play of the base game without choice of other wagering options which wager provides eligibility to all pay lines of the game and eligibility to the at least one bonus feature.

In a particular embodiment, there is provided gaming machine having a display means arranged to display a plurality of symbols in an array of n rows and m columns, where n and m are 2 or more, and a game control means arranged to control images displayed on the display means, the gaming machine being arranged to play an underlying game in which a prize is paid when a predetermined combination of symbols is displayed in a predetermined arrangement of symbol locations displayed on the display means, there being more than one arrangement of symbol locations for which a prize may be paid, and wherein the player is constrained to wager a single amount on each play of the underlying game which provides eligibility to win prizes for all arrangements of symbol locations for which a prize may be paid, as well as eligibility to any bonus features provided in the game without choice of other wagering options.

In a particularly preferred embodiment of the present invention, the gaming machine has a midtrim characterised by a single start or spin button is defined on the midtrim. No other type of start or spin button for initiating play of the underlying game may be provided.

The midtrim may also define "gamble" and "take win", "collect" "reserve" buttons or the like but no other buttons for either selecting the number of lines to be played or the amount of the wager on a game.

According to a further aspect of the invention, there is provided a game playing apparatus having a display means and being controlled by a game control means, the apparatus being arranged to play an underlying game in which a plurality of symbols is displayed on the display means in an array of n rows and m columns, where n and m are 2 or more, the game playing apparatus being arranged under the control of the game control means to play an underlying game in which a prize is won when a predetermined combination of symbols is displayed in a predetermined arrangement of symbol locations displayed on the display means, there being more than one arrangement of symbol locations for which a prize may be won, and wherein the player is constrained to wager a single amount on each play of the underlying game which provides eligibility to win prizes for all arrangements of symbol locations for which a prize may be won, as well as eligibility to any bonus features provided in the game without choice of other wagering options.

A game playing apparatus includes apparatus which is connectable to a network.

BRIEF DESCRIPTION OF THE DRAWINGS

The invention is now described by way of example with reference to the accompanying diagrammatic drawings in which.

DETAILED DESCRIPTION OF THE DRAWINGS

In the following detailed description, the methodology of the embodiments will be described and it is to be understood that it is within the capabilities of the noninventive worker in the art to introduce the methodology on any standard microprocessor based gaming machine by means of appropriate programming.

Traditional slot machines have made use of spinning reels to provide a display function with symbols carried on the reels being aligned to produce a game result which may or may not be a winning combination. Traditionally such machines paid a prize only on a centre row combination, however over the years more complex pay arrangements have developed in which winning combinations could appear on horizontal lines above and below the centre line, and also on diagonal lines in three reel machines. More recently, video displays have been used to simulate spinning reels. These machines are sometimes referred to as video reel machines. Pay lines have been devised which are not straight line arrangements of symbol locations although originally such pay line arrangements included only symbol locations that were horizontally or diagonally located adjacent each other and always included only one location in each column of the display. Even more recently machines have been devised where machines have been provided with matrices of pseudo spinning wheels such as a 3 by 3 matrix of reels where every position on the display screen is essentially independent and therefore could validly pay on vertical as well as horizontal pay lines.

With existing gaming machines having multiple pay lines available, also known as multi-line gaming machines the player purchases the option of playing for a win on lines other than the centre line. That is to say if he wagered one token the player played only for a winning combination on the centre line whereas if a number of tokens were wagered, the player may chose to wager some of those tokens on lines other than the centre line in the display.

As used herein a multiple pay line gaming machine refers to a gaming machine that makes at least two pay lines available on a play of the base or underlying game played on the machine.

Figure 1:
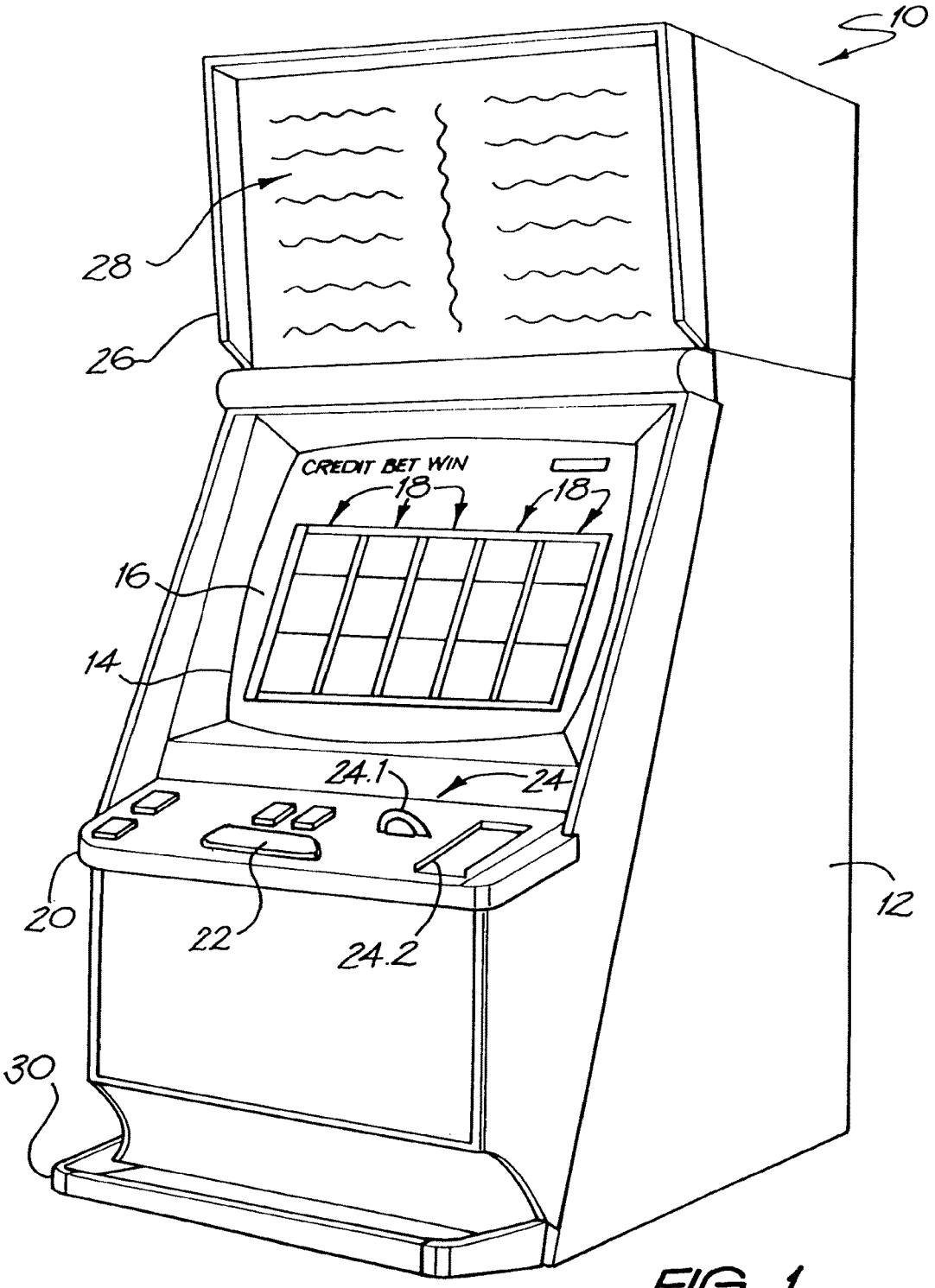
FIG. 1 shows a perspective view of a gaming machine, in accordance with the invention.

In FIG. 1, reference numeral 10 generally designates a gaming machine, including a game, in accordance with the invention. The machine 10 includes a console 12 having a display means in the form of a video display unit 14 on which a base or underlying game 16 is played, in use. The video display unit 14 may be implemented as a cathode ray screen device, a liquid crystal display, a plasma screen, or the like. The base game 16 is a spinning reel game which simulates the rotation of a number of spinning reels 18. A midtrim 20 of the machine 10 houses buttons including a start button 22 for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes pay tables, details of bonus awards, etc., described in more detail below.

A coin tray 30 is mounted beneath the console 12 for cash payouts from the machine 10.

Figure 2:
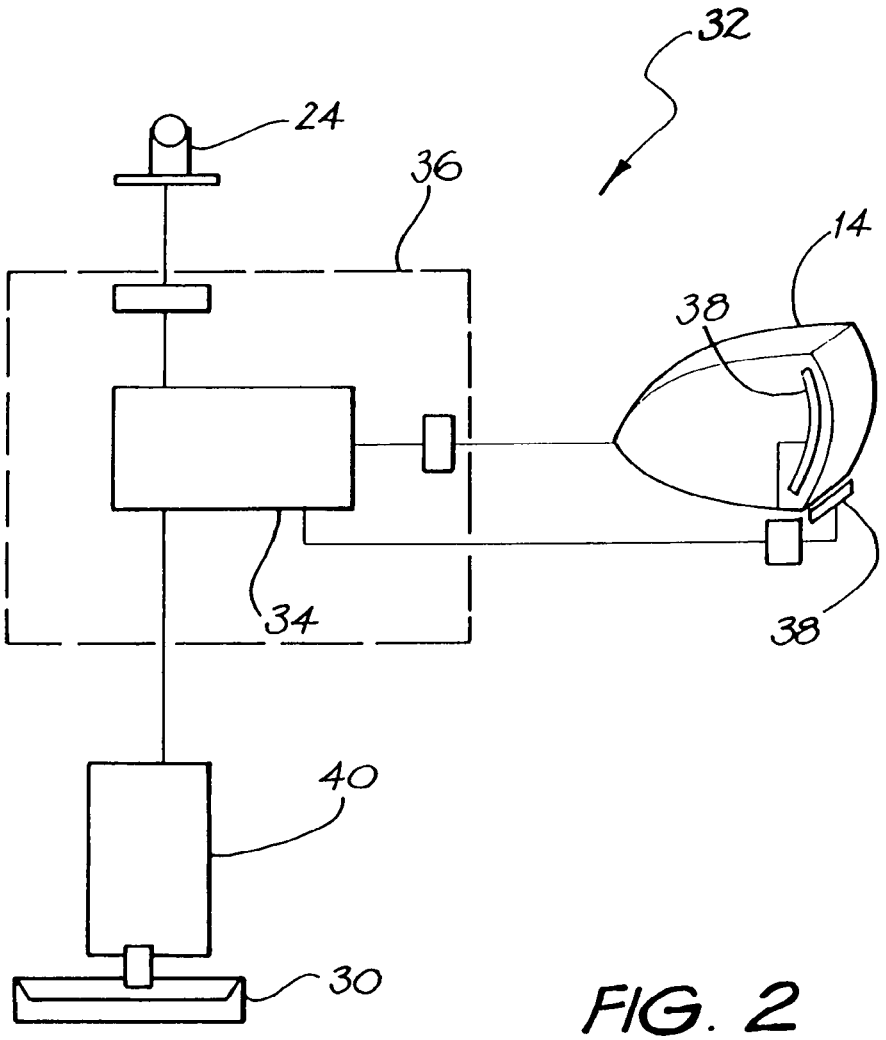
FIG. 2 shows a block diagram of a control circuit of the gaming machine.

Referring to FIG. 2 of the drawings, a control means or control circuit 32 is illustrated. A program which implements the game and user interface is run on a processor 34 of the control circuit 32. The processor 34 forms part of a controller 36 that drives the screen of the video display unit 14 and that receives input signals from sensors 38. The sensors 38 include sensors associated with the buttons and touch sensors mounted in the screen of the video display unit 14. The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

Figure 3:
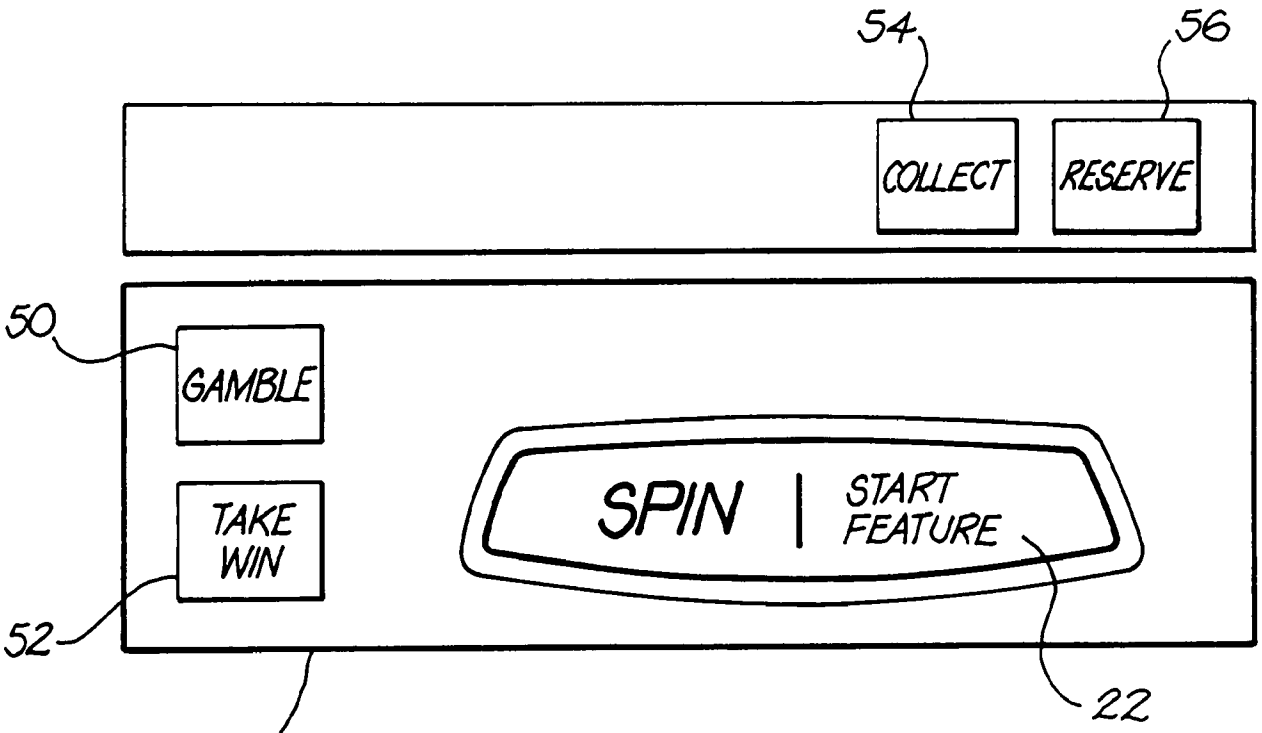
FIG. 3 shows a button panel of a midtrim of the gaming machine.

Referring to FIG. 3 and also to FIG. 1, in contrast with existing gaming machines, the midtrim 20 of the present invention does not include a bank of buttons for allowing a player to select the number of lines to be played and the bet per line. Instead, there is a single start/spin button 22 which is the only button that initiates play of the base game. (In alternative embodiments the button could be of the "touch-creen" type) There is only one betting option. In the described embodiment that one bet option, costs 100 credits and plays multiple lines, each game consisting of twenty lines. Prizes are paid as shown on the score card i.e. in contrast with existing gaming machines there is no multiplication of prizes by the bet per line. All games automatically contribute to and are eligible for the jackpot deluxe feature to be described in more detail below.

As best seen in FIG. 3, as well as defining the single spin button, the midtrim also defines "gamble" 50, "take win" 52, "collect" 54, and "reserve" 56, buttons. In playing the game, any gamble selections are made via touch screen buttons on the screen display 16 itself.

Figure 4:
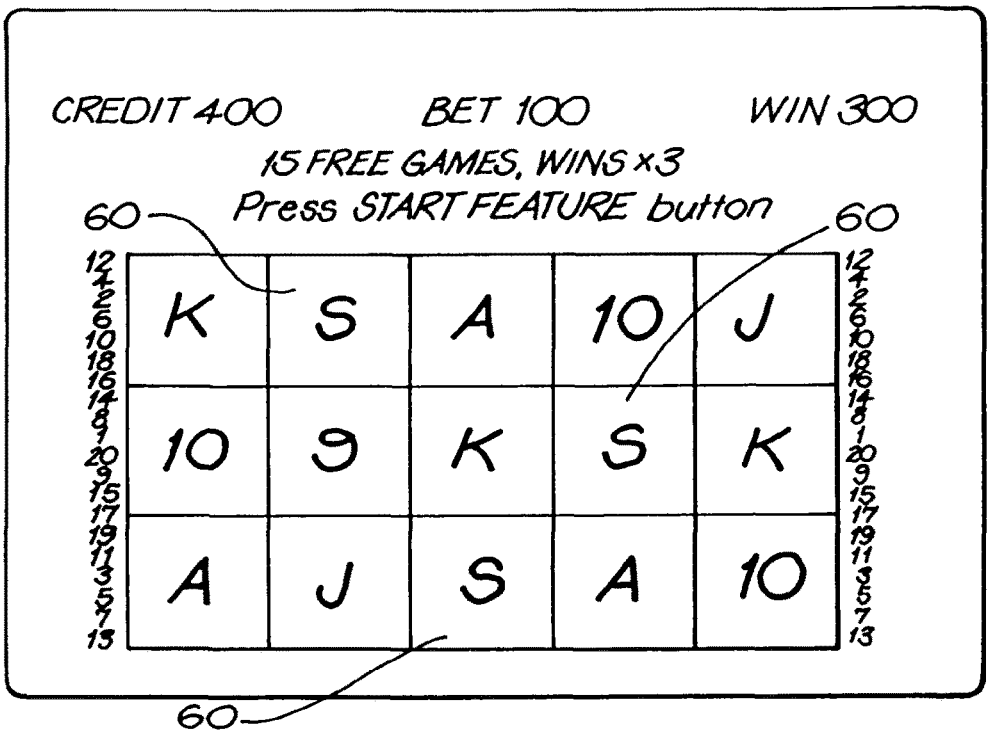
FIG. 4 shows a screen display of the gaming machine.

FIG. 4 illustrates a screen display at the start of a base or underlying game played on the gaming machine. Amongst other indicia typically displayed on virtual reels of the gaming machine display such as "9", "10", KING, ACE, and JACK, the screen illustrates three SCATTER symbols "S" 60. All symbols in the game pay left to right except for the SCATTER symbol "S" which pays when the SCATTER symbols appear on any line in any position. The WILD or substitute symbol "W" 62 (shown in FIG. 5) will substitute for all symbols except the SCATTER symbol and when substituting doubles the prize for the combination in which it substitutes.

In the commercial version of the game, the WILD and SCATTER symbols will relate to the theme of the underlying game. For example if the underlying game was Aristocrat's "Queen of the Nile" game then the SCATTER symbols might be PYRAMIDs and the WILD symbols, CLEOPATRAs.

Figure 9:
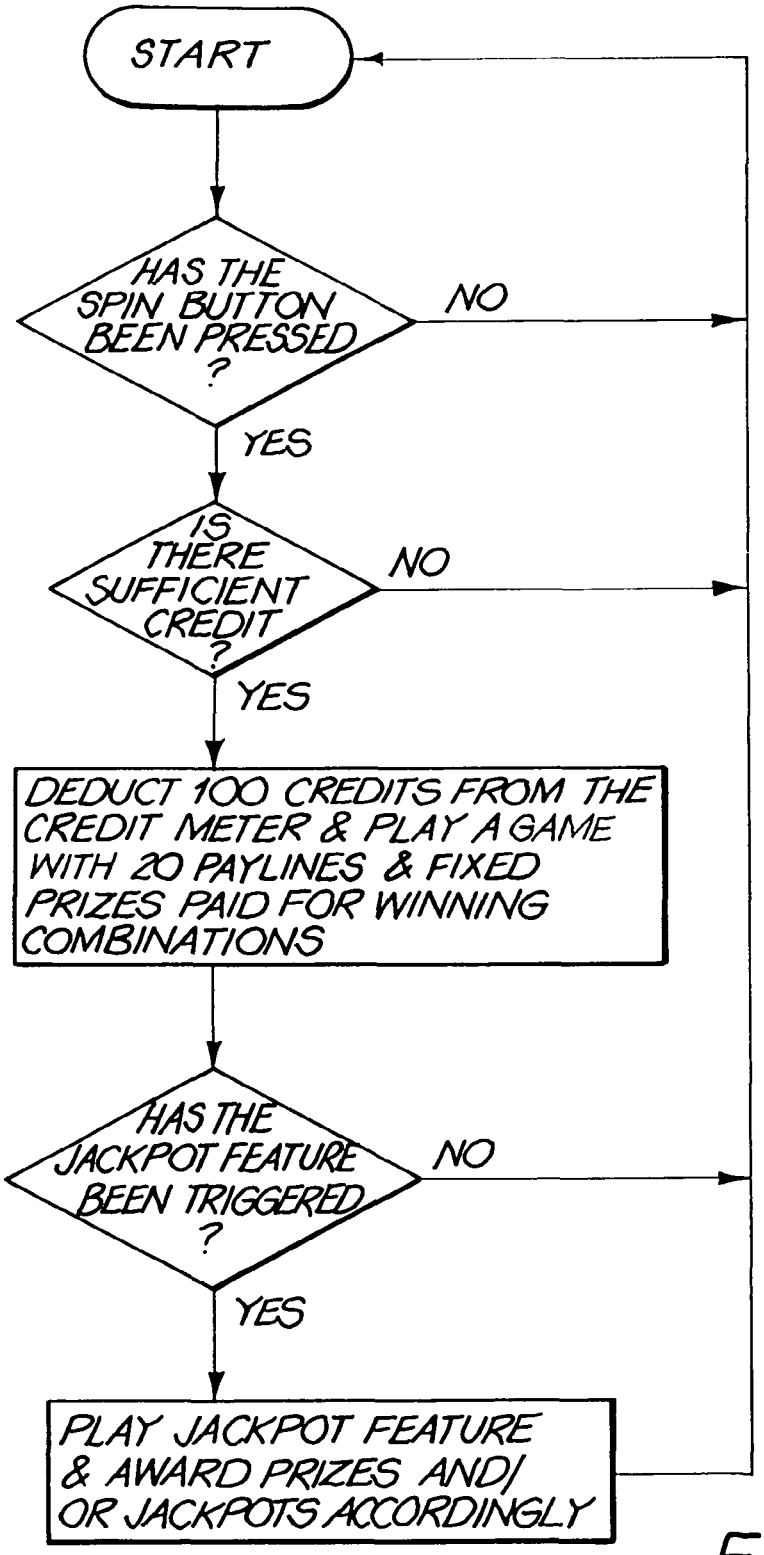
FIG. 9 shows a flow chart of the first embodiment of the game.

The bonus feature is in the form of a secondary or feature game which is triggered on a 3, 4 or 5 scatter win. As used herein the term bonus feature includes any game series such as a secondary or free game series that is distinct from the base or underlying game or eligibility for a prize or prize feature that is distinct from a standard pay table win in the base game. In the specific embodiment, the bonus features triggered are free games feature and jackpot deluxe feature. FIG. 9 is a flow chart setting out the steps in the triggering of a free game feature.

In the free games feature, fifteen free games are won. Wins for combinations of symbols in the series of free games are increased relative to wins for the corresponding combinations of symbols in the base game. In particular, all wins during the free game feature are tripled except for jackpot deluxe prizes and progressive meter amounts. If any scatter win occurs in the free game feature, a further fifteen additional free games are won. The total bet and lines played are the same as the game that started the feature.

The jackpot deluxe feature is as follows. Whenever the WILD symbol 62 appears anywhere in the window during the free game feature, all wins are first paid. The WILD symbols then flash until they are selected by the player by touching the WILD symbol on the screen. The selection can be made in any order. When the WILD symbol is touched an appropriate selection sound plays. The WILD symbol animates to reveal either a grand jackpot, major jackpot, minor jackpot, mini jackpot symbol or bonus credits of either 1000, 750, 500, 400, 300, 200 or 100 credits. The symbol revealed by the animation is determined by a probability table with each WILD symbol revealed using the same probability table.

Figure 8:
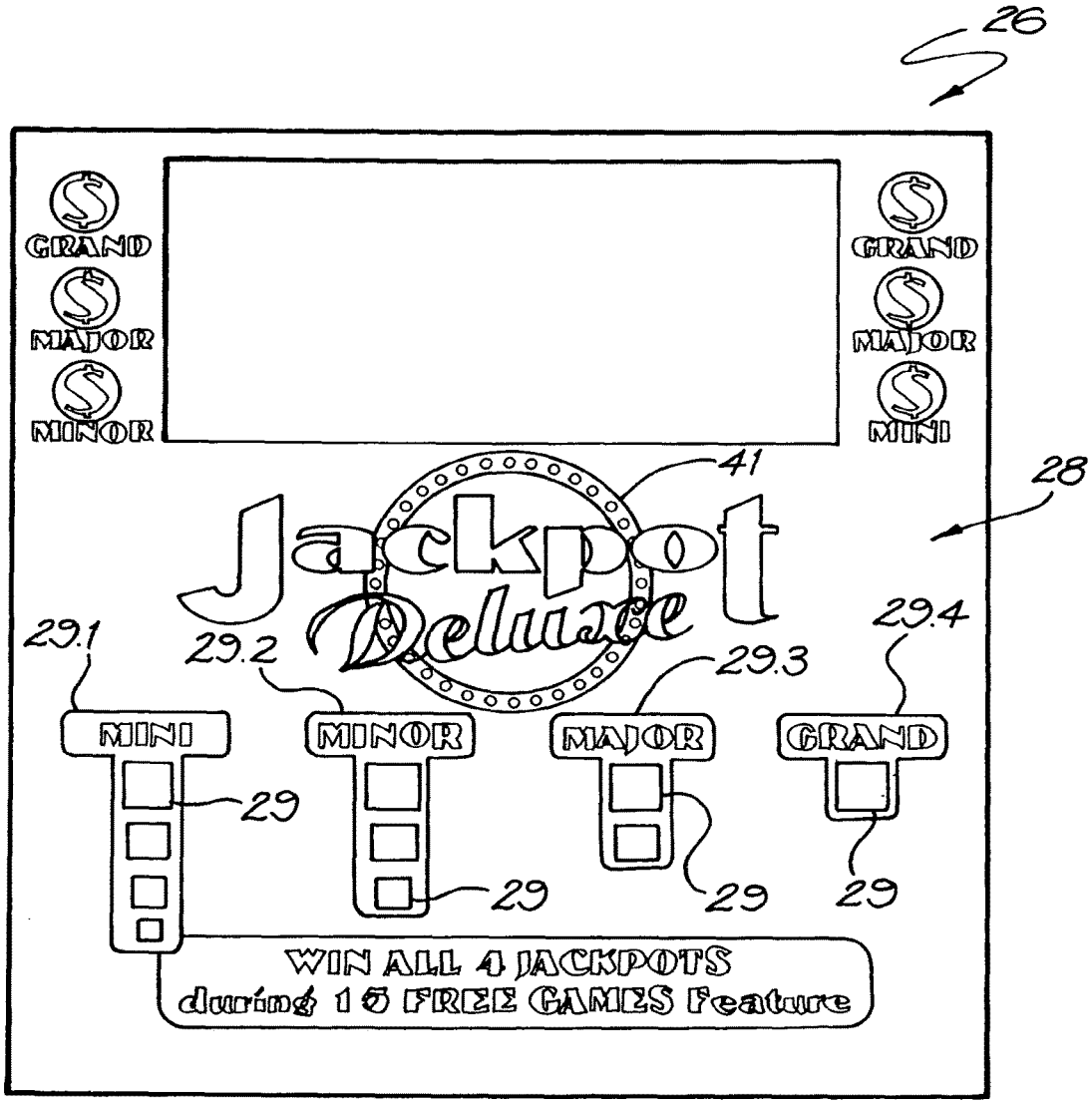
FIG. 8 illustrates a top box for the gaming machine.

For any bonus credits, wins are paid using the same methods as standard score card wins. Prizes are shown until the reel spin began. For jackpot symbols, the symbols revealed are collected and displayed on the gaming machine artwork shown in FIG. 8 and on the screen. The number of symbols required to win each jackpot is as follows.

GRAND: 1 GRAND symbols
MAJOR: 2 MAJOR symbols
MINOR: 3 MINOR symbols
MINI: 4 MINI symbols The artwork includes a number of LEDs around the artwork to light up in the feature. Electroluminescence is used to light up jackpot symbols 29 in lines underneath headings MINI 29.1, MINOR 29.2, MAJOR 29.3 and GRAND 29.4, the number of LEDs in each line reflecting the number of symbols required to win, being one for GRAND, two for MAJOR, three for MINOR and four for MINI. Also shown is a ring of flashing lights 41 which light up when a jackpot is won.

When a jackpot is won, the jackpot symbols for that jackpot are cleared, therefore each jackpot can be won again during the free games. The jackpot symbols are cleared at the end of each feature.

During the free games, when the player is required to touch a WILD symbol, an automatic selection will occur after a ten second lapse if no selection is made. Selection is made left to right if there are multiple WILD symbols on the screen.

FIGS. 4 to 8 illustrate the playing of the game. FIG. 4 illustrates the result of playing a game of the base or underlying game on the machine which results in three SCATTER symbols appearing on the screen display. As discussed above each game of the underlying game costs 100 credits and all twenty lines are automatically played.

The SCATTER symbols trigger the fifteen free games feature and on the press of the start button 22, the free game feature commences.

Figure 5:
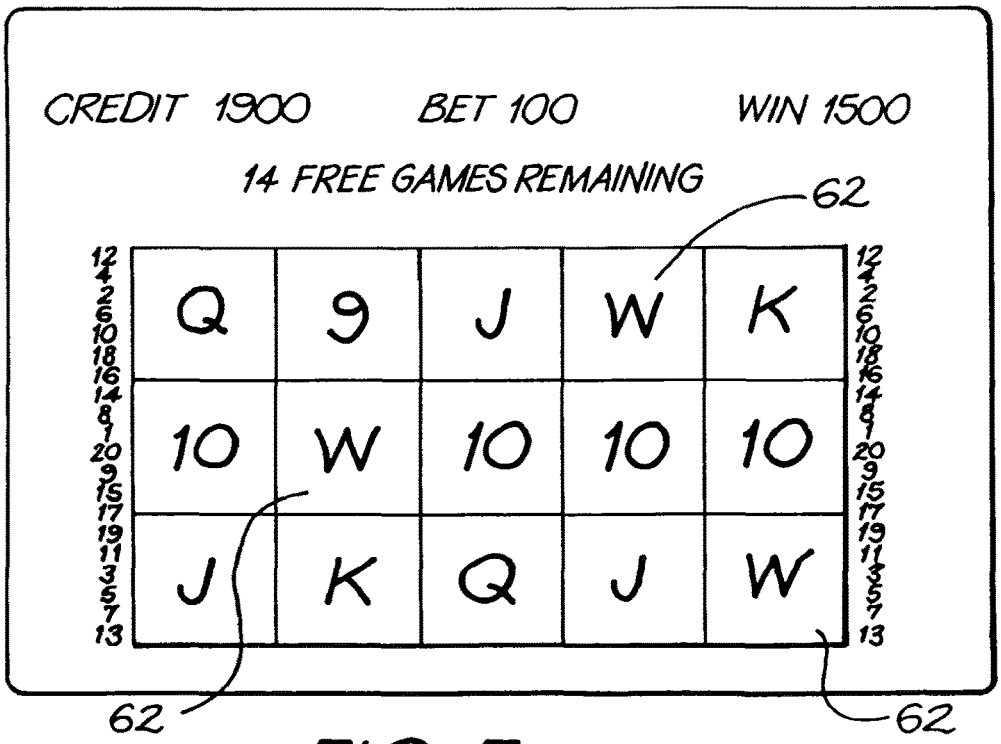
FIG. 5 shows the screen display at the end of the first feature game played.

FIG. 5 illustrates the result of the first feature game played. The win for the row of 10s is paid first, doubled due to the presence of the WILD symbol and tripled as it occurs in a free game feature. Any other wins on the other win lines are also paid at this time. After all winning lines have been first paid, the WILD symbols 62 flash until they are selected by the player.

Figure 6:
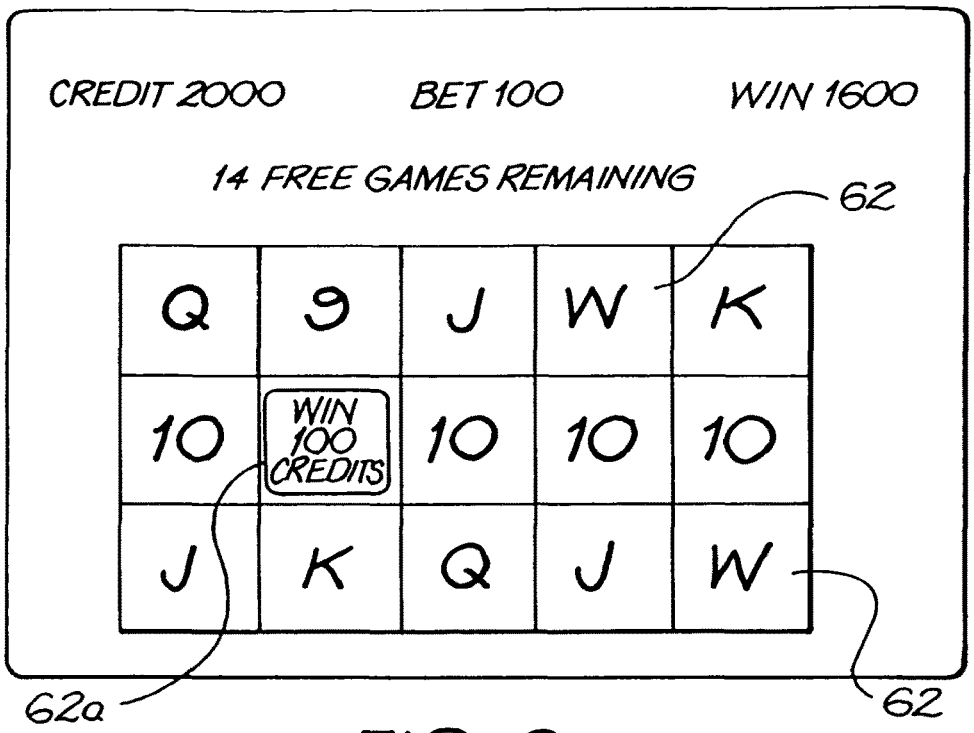
FIG. 6 shows the game after a first wild symbol prize has been revealed.

FIG. 6 illustrates the example after a first WILD symbol 62*a* is revealed indicating that the player has won 100 credits.

Figure 7:
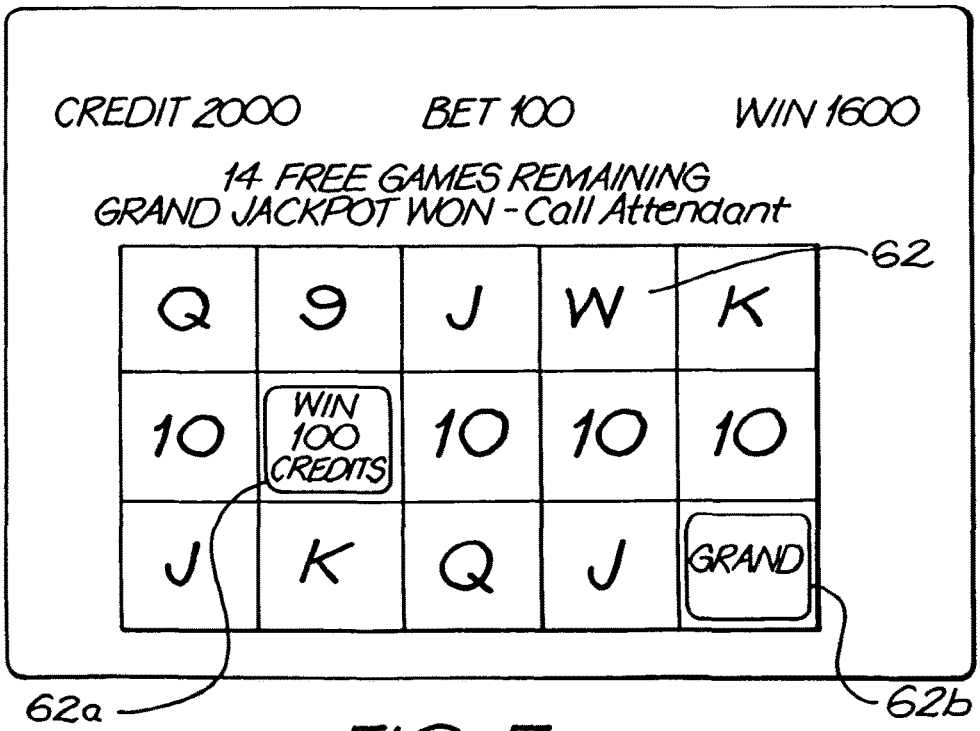
FIG. 7 shows the screen display after a second wild symbol prize has been revealed.

FIG. 7 illustrates the screen display after the player has touched a second WILD symbol 62*b* which reveals a GRAND jackpot prize which is automatically won as only one GRAND jackpot symbol is required to win the GRAND jackpot prize.

The bonus feature may also be a progressive jackpot prize.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A method of a gaming machine, the method comprising:

determining that a game play button of a gaming machine has been actuated;

deducting a predetermined wager amount from a credit meter of the gaming machine in response to said determining;

displaying an outcome for a base game on a display of the gaming machine in response to said determining, wherein the outcome comprises a plurality of base game symbols;

awarding a series of bonus games based on the plurality of base game symbols;

displaying, for each bonus game of the series of bonus games, a bonus game outcome on the display of the gaming machine, the bonus game outcome comprising a plurality of bonus game symbols selected from a first group of symbols that includes at least a WILD symbol;

awarding, for each bonus game, a prize in response to determining that the plurality of bonus game symbols for that respective bonus game of the series of bonus games comprises a winning combination of bonus game symbols;

replacing each instance of the WILD symbol in each bonus game outcome with a replacement symbol selected from a second group of symbols that includes at least a first jackpot symbol and a second jackpot symbol respectively associated with a first jackpot prize and a second jackpot prize;

accumulating both the first jackpot symbols and the second jackpot symbols generated during each bonus game from a plurality of bonus games in the series of bonus games to obtain a first accumulated jackpot symbols total that corresponds to a first quantity of first jackpot symbols generated during the plurality of bonus games and a second accumulated jackpot symbols total that corresponds to a second quantity of second jackpot symbols generated during the plurality of bonus games;

awarding the first jackpot prize in response to determining that the first accumulated jackpot symbols total achieved a first predetermined plurality of first jackpot symbols; and awarding the second jackpot prize in response to determining that the second accumulated jackpot symbols total achieved a second predetermined plurality of second jackpot symbols.

2. The method of claim 1, further comprising:

presenting a score card of winning combinations and prizes for the base game; and awarding a prize based on the plurality of base game symbols generated for the base game;

wherein said awarding the prize for the base game comprises paying the prize per the score card without multiplying the prize by a wagered amount per pay line of a plurality of pay lines.

3. The method of claim 1, further comprising initiating play of a bonus game of the series of bonus games in response to determining the game play button has been actuated after said awarding the series of bonus games.

4. The method of claim 1, wherein said awarding the prize comprises awarding the prize in response to determining that the winning combination of bonus game symbols aligns along a pay line of a plurality of pay lines.

5. The method of claim 1 further comprising: receiving, via a touch screen of the gaming machine, a user selection of an instance of the WILD symbol in the bonus game outcome of the series of bonus games; replacing the selected instance of the WILD symbol with another symbol selected from the second group of symbols; and awarding another prize based on the selected another symbol.

6. The method of claim 1, wherein the first jackpot prize is a progressive jackpot prize.

7. The method of claim 1, wherein said replacing includes replacing an instance of the WILD symbol after a predetermined period has lapsed without a user selection.

8. The method of claim 1, further comprising establishing a credit balance in response to a credit input mechanism of the gaming machine receiving a physical item associated with a credit value.

9. A game machine, comprising:

a display configured to display outcomes of played games;

a game play button configured to initiate play of games;

a credit input device configured to receive game credits; and a game controller configured to:

determine whether the game play button of a gaming machine has been actuated;

deduct a predetermined wager amount from game credits received via the credit input device in response to determining that the game play button has been actuated;

generate a base game outcome in response to determining the game play button has been actuated, wherein the base game outcome comprises a plurality of base game symbols;

award a series of bonus games based on the plurality of base game symbols, wherein each bonus game displays a bonus game outcome comprising a plurality of bonus game symbols selected from a first group of symbols that includes at least a WILD symbol;

award, for each bonus game, a prize in response to determining that the plurality of bonus games symbols for that respective bonus game of the series of bonus games comprises a winning combination of bonus game symbols;

replace each instance of the WILD symbol in each bonus game outcome with a replacement symbol selected from a second group of symbols that includes at least a first jackpot symbol and a second jackpot symbol respectively associated with a first jackpot prize and a second jackpot prize;

respectively update a first jackpot symbols total and a second jackpot symbols total for each first jackpot symbol and each second jackpot symbol generated during each bonus game of a plurality of bonus games in the series of bonus games such that the first jackpot symbols total and the second jackpot symbols total respectively corresponds to a first quantity of first jackpot symbols and a second quantity of second jackpot symbols collectively generated over the plurality of bonus games in the series of bonus games; and award both the first jackpot prize and the second jackpot prize in response to determining that the first jackpot symbols total corresponds to a first predetermined plurality of first jackpot symbols and that the second jackpot symbols total corresponds to a second predetermined plurality of second jackpot symbols.

10. The game machine of claim 9, wherein the game controller is further configured to pay a prize per a score card of winning combinations for the base game without multiplying the prize by a wagered amount per pay line.

11. The game machine of claim 9, wherein the game controller is further configured to initiate play of a bonus game of the series of bonus games in response to determining the game play button has been actuated after awarding the series of bonus games.

12. The game machine of claim 9, wherein the game controller is further configured to award the prize in response to determining that the winning combination of bonus game symbols aligns along a pay line of a plurality of pay lines.

13. The game machine of claim 9 wherein: the display comprises a touch screen; and the game controller is further configured to: receive, via the touch screen, a user selection of an instance of the WILD symbol in the bonus game outcome of the series of bonus games; replace the selected instance of the WILD symbol with another symbol selected from the second group of symbols; and award another prize based on the selected another symbol.

14. The game machine of claim 9, wherein the first jackpot prize is a progressive jackpot prize.

15. The game machine of claim 9, wherein the first predetermined plurality of first jackpot symbols specifies a different quantity of symbols than the second predetermined plurality of second jackpot symbols.

16. A non-transitory computer readable storage medium comprising a plurality of instructions stored thereon, that in response to being executed, result in a game controller:

determining whether a game play button of a gaming machine has been actuated;

deducting a predetermined wager amount from a credit meter of the gaming machine in response to determining that the game play button has been actuated;

generating a base game outcome in response to determining the game play button has been actuated, wherein the base game outcome comprises a plurality of base game symbols;

awarding a prize based upon the plurality of base game symbols and a plurality of pay lines, wherein each pay line of the plurality of pay lines defines a symbol arrangement of the plurality of symbols for determining winning combinations;

awarding a series of bonus games based on the plurality of base game symbols, wherein each bonus game of the series of bonus games generates a bonus game outcome comprising a plurality of bonus game symbols selected from a first group of symbols that includes at least a WILD symbol;

awarding, for each bonus game, another prize in response to determining that the plurality of bonus game symbols for that respective bonus game of the series of bonus games comprises a winning combination of bonus game symbols;

replacing each instance of the WILD symbol in each bonus game outcome with a replacement symbol selected from a second group of symbols that includes at least a first jackpot symbol and a second jackpot symbol respectively associated with a first jackpot prize and a second jackpot prize;

awarding a first jackpot prize in response to determining that the bonus game outcomes of the series of bonus games collectively generated, across a plurality of bonus games in the series of bonus games, a first predetermined plurality of first jackpot symbols; and awarding a second jackpot prize in response to determining that the bonus game outcomes of the series of bonus games collectively generated, across the plurality of bonus games in the series of bonus games, a second predetermined plurality of second jackpot symbols.

17. The non-transitory computer readable storage medium of claim 16, wherein the plurality of instructions further result in the game controller paying a prize per a score card of winning combinations and prizes without multiplying the prize by a wagered amount per pay line of the plurality of pay lines.

18. The non-transitory computer readable storage medium of claim 16, wherein the plurality of instructions further result in the game controller initiating play of a bonus game of the series of bonus games in response to determining the game play button has been actuated after awarding the series of bonus games.

19. The non-transitory computer readable storage medium of claim 16, wherein the first jackpot prize is a progressive jackpot prize.

20. The non-transitory computer readable storage medium of claim 16, wherein the first predetermined plurality of first jackpot symbols specifies a different quantity of symbols than the second predetermined plurality of second jackpot symbols.

* * * * *